United States Patent [19]

Shapiro et al.

[11] 3,985,589

[45] Oct. 12, 1976

[54] PROCESSING COPPER BASE ALLOYS

[75] Inventors: Stanley Shapiro, New Haven; Richard D. Lanam, Hamden, both of Conn.

[73] Assignee: Olin Corporation, New Haven, Conn.

[22] Filed: Nov. 1, 1974

[21] Appl. No.: 520,053

[52] U.S. Cl. ..... 148/160; 148/12.7 C; 148/32.5

[51] Int. Cl.[2] ..... C22F 1/08; C21D 1/00

[58] Field of Search ..... 148/12.7, 160, 32.5; 75/153, 159, 154, 157, 157.5, 161

[56] References Cited

UNITED STATES PATENTS

| | | | |
|---|---|---|---|
| 2,225,339 | 12/1940 | Harrington | 148/12.7 |
| 2,275,188 | 3/1942 | Harrington | 148/160 X |
| 2,286,734 | 6/1942 | Harrington | 148/12.7 |
| 3,133,839 | 5/1964 | Thomas | 148/12.7 |
| 3,712,837 | 1/1973 | Shapiro et al. | 148/12.7 |
| 3,841,921 | 10/1974 | Shapiro et al. | 148/160 |
| 3,880,678 | 4/1975 | Shapiro et al. | 148/11.5 R |

OTHER PUBLICATIONS

Steel Processing, Feb. 1944, pp. 101–105.

*Primary Examiner*—C. Lovell

*Attorney, Agent, or Firm*—Robert H. Bachman; David A. Jackson

[57] ABSTRACT

Processing copper base alloys to improve the stress corrosion resistance thereof. Copper base alloys containing from 12.5 to 30% nickel and 12.5 to 30% manganese are subjected to a duplex aging treatment in order to improve the stress corrosion resistance thereof.

4 Claims, No Drawings

PROCESSING COPPER BASE ALLOYS

BACKGROUND OF THE INVENTION

Copper base alloys are known which contain relatively large amounts of nickel and manganese. Alloys of this type are highly desirable since they are capable of obtaining high yield strengths upon aging. U.S. Pat. No. 3,712,837 discloses processing such alloys in order to obtain good yield strengths upon aging and good stress corrosion resistance.

The copper-nickel-manganese age hardenable alloys have suffered from inadequate stress corrosion resistance, which has severely limited the applications where they can be used. Parts manufactured from these alloys may be susceptible to stress corrosion cracking when exposed to the atmosphere or an accelerated stress corrosion cracking test environment. Stress corrosion cracking can be a serious problem in any formed part, such as springs, lock parts and the like.

Accordingly, it is a principal object of the present invention to provide a process which is capable of greatly improving the stress corrosion resistance of the nickel and manganese containing copper base alloys.

It is a further object of the present invention to provide a process as aforesaid which is simple and convenient to use on a commercial scale.

Further objects and advantages of the present invention will appear hereinafter.

SUMMARY OF THE INVENTION

In accordance with the present invention it has been found that the foregoing objects and advantages may be readily achieved. The process of the present invention comprises providing a wrought copper base alloy containing from 12.5 to 30% nickel, from 12.5 to 30% manganese, balance essentially copper, aging said alloy at a temperature of from 400° to 475° C for from 30 minutes to 10 hours, and further aging said alloy at a temperature of 150° to 375° C for from 30 minutes to 10 hours.

In accordance with the process of the present invention it has been surprisingly found that the foregoing duplex aging treatment provides an unexpected and suprising improvement in the stress corrosion life of the aforesaid copper base alloys in both industrial and marine environments. This affords considerable versatility in the utilization of this alloy system.

DETAILED DESCRIPTION

The process of the present invention effectively improved the stress corrosion cracking properties of copper base alloys containing from 12.5 to 30% nickel and from 12.5 to 30% manganese. Preferably, both the nickel and manganese contents should range from 15 to 25%. Preferred alloys utilize a nickel to manganese ratio of at least 0.75 and generally 1.0 or higher.

It has been found that the copper-nickel-manganese alloys of the present invention preferably contain one or more additives selected from the group consisting of: Arsenic from 0.005 to 0.1%; antimony from 0.005 to 0.1%; aluminum from 0.1 to 5%; magnesium from 0.01 to 5%; boron from 0.001 to 0.1%; zinc from 0.1 to 3.5%; tin from 0.01 to 3%; zirconium from 0.01 to 2%; titanium from 0.01 to 2%; chromium from 0.01 to 1%; iron from 0.1 to 5%; and cobalt from 0.05 to 1%. Naturally, other additives may be desirable in order to achieve or accentuate a particular property and also conventional impurities may be tolerated.

As indicated hereinabove, the process of the present invention improves the stress corrosion resistance of the foregoing alloys in the wrought form, and preferably in the temper rolled condition. Casting of the alloys processed in accordance with the present invention is not particularly significant and generally any convenient casting method may be employed. Generally, the alloy of the present invention is processed by breakdown of the cast ingot into strip using a hot rolling operation followed by cold rolling and annealing cycles to reach final gage. The starting hot rolling temperature should be in the range of 700° to 900° C. The alloy is capable of cold rolling reductions in excess of 90%, but the cold rolling reduction should preferably be between 30 and 80% in order to control the grain size. It has been found that an average grain size less than 0.015 mm is required in order to provide the optimum fracture toughness. An average grain size of this order of magnitude can be obtained by controlling cold rolling annealing times and annealing temperatures. In general, annealing temperatures in the range of 550° to 900° C for at least 1 minute can give the required grain size, with 10 hours being the practical upper limit and 2 hours being the preferred upper limit. Generally, the alloy is annealed for from 5 minutes to 2 hours. As indicated hereinabove, the cold rolling and annealing cycles are repeated as desired depending upon gage requirements. Generally, from 2 to 4 cycles of cold rolling and annealing are preferred.

Thus, the process of the present invention utilizes the foregoing copper base alloys in the wrought condition. The duplex aging treatment of the present invention may utilize the foregoing alloys in the temper rolled condition or annealed condition depending upon final requirements.

The initial aging is carried out in a higher temperature regime of 400° to 475° C for from 30 minutes to 10 hours. This is followed by a final lower temperature aging treatment in the low temperature regime of 150° to 375° C for times from 30 minutes to 10 hours.

If desired, the alloy may be cooled to room temperature following the higher temperature aging treatment. The alloy may be set aside for further processing, or converted to the formed part and the final lower temperature treatment provided subsequently, thereby greatly improving the stress corrosion resistance thereof.

If desired, the alloy may be aged at the higher temperature and followed directly by the lower temperature aging treatment. It has been found that preferred properties are obtained by cooling from the first or high aging temperature to the second aging temperature at a slower cooling rate not exceeding 100° C per hour, for example, as by furnace cooling. Cooling rates following the low temperature aging treatment are not critical.

The present invention may be more readily understandable from a consideration of the following illustrative examples.

EXAMPLE I

A 10 lb. ingot of a copper base alloy having the composition set forth in Table I below was prepared in strip form by the procedure outlined in the following example:

TABLE I

| Alloy Composition | |
|---|---|
| Nickel | - 25% |
| Manganese | - 17% |
| Zinc | - 2% |
| Aluminum | - 0.5% |
| Arsenic | - 0.04% |
| Copper | - Balance |

The alloy was direct chill cast from 1200° C into a steel mold. The resultant ingot was soaked at 845° C and hot rolled from 1.5 inches to 0.250 inch. The resultant hot rolled plate was cold rolled to 0.100 inch and annealed at 600° C for 30 minutes. The material was then cold rolled 60% to 0.040 inch and again annealed at 600° C for 30 minutes. The alloy was then cold rolled an additional 25% to 0.030 inch.

EXAMPLE II

The following example shows the stress corrision properties of the foregoing material processed in accordance with the present invention and processed by a comparative procedure. Some samples were processed in accordance with the duplex aging treatment of the present invention and others were not.

The material described in Example I was fabricated into standard tensile specimens and sheared into 6.0 inches by 0.625 inch strips transverse to the rolling direction. The sheared strips were milled to 6.0 inches by 0.500 inch strips. This procedure is necessary to eliminate edge effects from the shearing operation. The strips were formed around a ¾ inch diameter mandrel to a 90° permanent set. Formed samples and tensile specimens were aged together. Some material was aged at 450° C for 6 hours (identified in Table II, below as sample A). This material represents samples given a conventional, one step aging treatment with the resultant properties being shown in Table II, below. Other samples (identified in Table II, below as sample B) were given the duplex aging treatment of the present invention. These samples were first aged in the higher temperature regime of 450° C for 4 hours followed by furnace cooling from 450° C to 350° C at a rate of 25° C per hour and held at a temperature of 350° C for 2 hours.

The tensile specimens were evaluated to determine the yield strength, tensile strength and elongation. The formed and aged stress corrosion samples were sprung into a jig so the legs were 1 ½ inches apart. (Since they are tested in a U configuration, they are generally referred to as U-bend samples.) The stress at the apex of the U-bend is approximately 90% of the yield strength. The results of the U-bend and tensile tests are shown in Table II, below. Five U-bend samples each were tested in a severe industrial environment and in a severe marine environment. The time-to-failure listed in the table is the mean of the five samples.

TABLE II

| Sample | Yield Strength ksi at 0.2% Offset | Tensile Strength ksi | Percent Elongation 2" Gauge | SCR-Days to Failure | |
|---|---|---|---|---|---|
| | | | | Industrial Environment | Marine Environment |
| A | 184.7 | 196.5 | 7.0 | 81 | 39 |
| B | 182.0 | 198.0 | 6.0 | 332 | 65 |

EXAMPLE III

A 10 lb. ingot of a copper base alloy having the composition set forth in Table III, below was prepared in strip form by the procedure outlined in Example I.

TABLE III

| | |
|---|---|
| Nickel | - 25% |
| Manganese | - 17% |
| Zinc | - 2% |
| Aluminum | - 0.5% |
| Antimony | - 0.04% |
| Copper | - Balance |

EXAMPLE IV

The following is another example of the improvement in stress corrosion performance realized by use of the duplex aging treatment. Tensile and stress corrosion samples of the material prepared in Example III were aged in both the conventional and duplex manner. The aging temperature and time for the conventional aging were the same as described for Sample A in Example II. Likewise, the duplex aging treatment was the same as described for Sample B in Example II. The results of the tensile tests plus time-to-failure of the U-bend samples in the industrial and marine environments are presented in Table IV, below.

TABLE IV

| Sample | Yield Strength ksi at 0.2% Offset | Tensile Strength ksi | Percent Elongation 2" Gauge | SCR-Days to Failure | |
|---|---|---|---|---|---|
| | | | | Industrial Environment | Marine Environment |
| A | 183.5 | 193.5 | 5.3 | 69 | 52 |
| B | 126.8 | 187.3 | 5.5 | 227 | 84 |

The foregoing data clearly shows that significant increases in the time-to-failure for the U-bends in both the industrial and marine environments are obtained for material given the duplex aging treatment of the present invention rather than the conventional aging treatment.

This invention may be embodied in other forms or carried out in other ways without departing from the spirit or essential characteristics thereof. The present embodiment is, therefore, to be considered as in all respects illustrative and not restrictive, the scope of the invention being indicated by the appended claims, and all changes which come within the meaning and range of equivalency are intended to be embraced therein.

What is claimed is:

1. A process for obtaining improved stress corrosion resistance which comprises: providing a copper base alloy in the wrought condition consisting essentially of from 12.5 to 30% nickel, 12.5 to 30% manganese, balance copper; initially aging said material at a temperature of from 400° C for from 30 minutes to 10 hours; following said initial aging step by cooling at a rate less than 100° C per hour to a temperature of from 150° to 375° C; and finally aging said material at a temperature of from 150° to 375° C for from 30 minutes to 10 hours.

2. A process according to claim 1 wherein said copper base alloy is provided in the temper rolled condition.

3. A process according to claim 1 wherein said copper base alloy is provided in the temper rolled and annealed condition.

4. A process according to claim 1 wherein said copper base alloy contains a material selected from the group cnsisting of: arsenic from 0.005 to 0.1%; antimony from 0.005 to 0.1%; aluminum from 0.1 to 5%; magnesium from 0.01 to 5%; boron from 0.001 to 0.1%; zinc from 0.1 to 3.5%; tin from 0.01 to 3%; zirconium from 0.01 to 2%; titanium from 0.01 to 2%; chromium from 0.01 to 1%; iron from 0.1 to 5%; cobalt from 0.05 to 1% and mixtures thereof.

* * * * *

UNITED STATES PATENT AND TRADEMARK OFFICE

CERTIFICATE OF CORRECTION

PATENT NO. : 3,985,589

DATED : October 12, 1976

INVENTOR(S) : Stanley Shapiro and Richard D. Lanam

It is certified that error appears in the above-identified patent and that said Letters Patent are hereby corrected as shown below:

Column 2, line 23, after the word "rolling" a comma (,) should be inserted.

Column 3, line 30, the word "corrision" should read ---corrosion---.

Column 5, line 6, ---to 475°C--- should be inserted after "400°C".

Column 6, line 7, the word "cnsisting" should read ---consisting---.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*